US005829230A

United States Patent [19]

Hartz

[11] Patent Number: 5,829,230

[45] Date of Patent: Nov. 3, 1998

[54] METHOD FOR BAGGING COMPRESSIBLE ABSORBENT ARTICLES

[75] Inventor: Wolfgang Hartz, Kiel, Germany

[73] Assignee: McNeil-PPC, Inc., Skillman, N.J.

[21] Appl. No.: 935,118

[22] Filed: Sep. 22, 1997

Related U.S. Application Data

[62] Division of Ser. No. 597,367, Feb. 8, 1996, Pat. No. 5,722,774.

[30] Foreign Application Priority Data

Aug. 2, 1995 [DE] Germany ..... 195044157.7

[51] Int. Cl.[6] ..... B65B 43/04

[52] U.S. Cl. ..... 53/455; 53/412; 53/459; 53/469

[58] Field of Search ..... 53/133.8, 284.7, 53/385.1, 386.1, 412, 447, 455, 459, 469, 540, 562, 570

[56] References Cited

U.S. PATENT DOCUMENTS

| | | |
|---|---|---|
| 3,534,520 | 10/1970 | Moran . |
| 3,952,480 | 4/1976 | Nordstrom . |
| 4,453,370 | 6/1984 | Titchenal . |
| 4,966,286 | 10/1990 | Muckenfuhs . |
| 5,022,216 | 6/1991 | Muckenfuhs et al. . |
| 5,150,561 | 9/1992 | Muckenfuhs . |
| 5,158,499 | 10/1992 | Guckenberger . |
| 5,282,687 | 2/1994 | Yee . |
| 5,361,905 | 11/1994 | McQueeny et al. . |
| 5,380,094 | 1/1995 | Schmidt et al. . |
| 5,417,040 | 5/1995 | Davoren . |
| 5,464,285 | 11/1995 | Anderson . |

*Primary Examiner*—Daniel Moon

[57] ABSTRACT

Method for bagging plurality of compressible absorbent articles which are arranged in parallel, one beside the other. The bag has an approximately rectangular base, a front side, a rear side, two narrow sides, and an upper side and is closed on all sides. The bag also has a line of weakness which marks an opening for the individual removal of the articles. The height of the bag is greater than the depth of the bag, the line of weakness extends, midway along the bag, from the longitudinal center of the upper side, toward the base, about half way down the front side of the bag. The base has a downwardly directed supporting band. The absorbent articles do not exerting sufficient pressure on any of the sides of the bag filled with said articles to cause the opening to gape open. The opening can be formed by bending the bag to open the line of weakness, and it closes after removal of the product when the bag is replaced on its supporting edge. Thus, the bag provides a substantial hygienic storage of absorbent products.

4 Claims, 7 Drawing Sheets

METHOD FOR BAGGING COMPRESSIBLE ABSORBENT ARTICLES

This is a division of application Ser. No. 08/597,367, filed Feb. 8, 1996, now U.S. Pat. No. 5,722,774 which is hereby incorporated by reference.

BACKGROUND OF THE INVENTION

The invention relates to a flexible bag and to a process for producing the bag and for packaging compressible, absorbent articles in the same.

U.S. Pat. No. 5,282,687 discloses bags of this generic type which, in terms of production and structure, are comparatively costly and complicated, and do not provide simple and hygienic handling. In the case of this bag, provision is made for at least one line of weakness which, after being destroyed, makes it impossible for absorbent articles to be stored hygienically and reasonably securely. This is because said known bag pack is to be of such a configuration that the bag opening formed by the destroyed line of weakness gapes open in order to permit simple removal of further articles out of the bag. However, this leads to the risk of contamination of the articles which, in the case of absorbent articles for feminine hygiene, may have consequences which are hazardous to the health. This is even more so considering that said known bag is not dimensionally stable and can thus easily fall over, with the result that the articles contained therein may be contaminated, thus aggravating the risks and disadvantages outlined above.

SUMMARY OF THE INVENTION

The object of the invention is thus to improve a flexible bag of the known generic type such that the bag can be produced using a smaller amount of material and can be opened and closed in a user-friendly manner. The intention is for it to be possible to remove an article in a simple and hygienic manner. Furthermore, the bag is intended to have good dimensional stability, with the result that maintaining the quality of the articles packaged therein is largely ensured.

The invention relates to a flexible plastic bag for a plurality of compressible absorbent articles which are arranged in parallel one beside the other. The bag has an approximately rectangular base, a front side, a rear side, two narrow sides, and an upper side. The bag is being closed on all sides and is provided with a line of weakness which marks an opening for the individual removal of the articles. The height of the bag is greater than the depth of the bag, the line of weakness extends, midway along the bag, from the longitudinal center of the upper side, toward the base, approximately halfway down of the front side of the bag. The base of the bag is enclosed by a downwardly directed supporting band. The compressible articles do not exerting any great amount of pressure on any of the sides of the bag filled with said articles.

It is possible to open the flexible bag merely by bending it to separate the bag at the line of weakness. In this arrangement, an article can be removed very easily from the bag because the articles in the bag are not exposed to any particular stressing. After an article has been removed, the opening closes to a great extent when the bag is replaced in an upright position on its supporting border which projects downwards from the base.

BRIEF DESCRIPTION OF THE DRAWINGS

The invention is explained in more detail hereinbelow with reference to the schematic drawing of an exemplary embodiment, in which drawing.

DETAILED DESCRIPTION OF THE INVENTION

Figure 1:
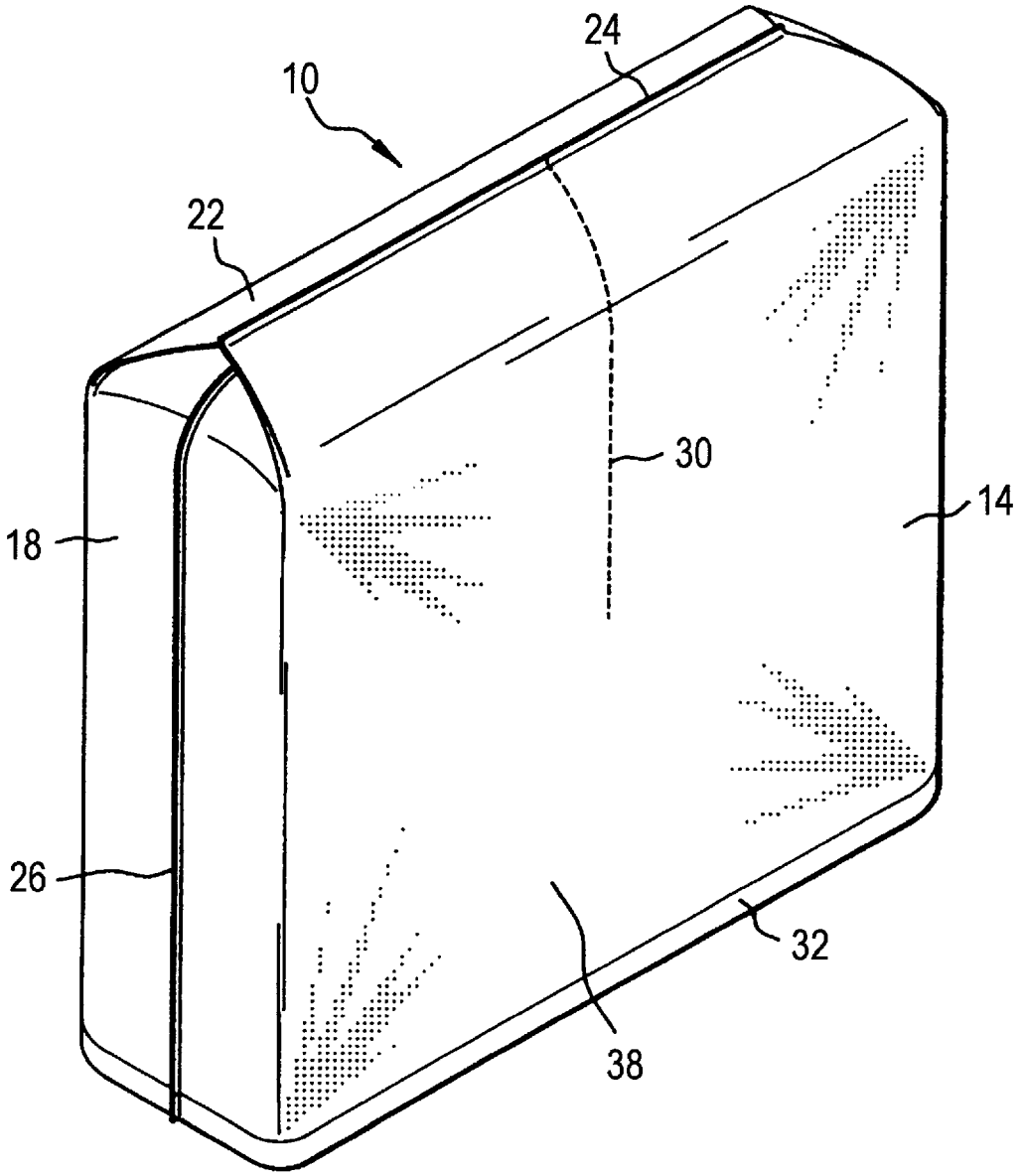
FIG. 1 shows a perspective view of a closed, flexible bag in the upright position.
Figure 2:
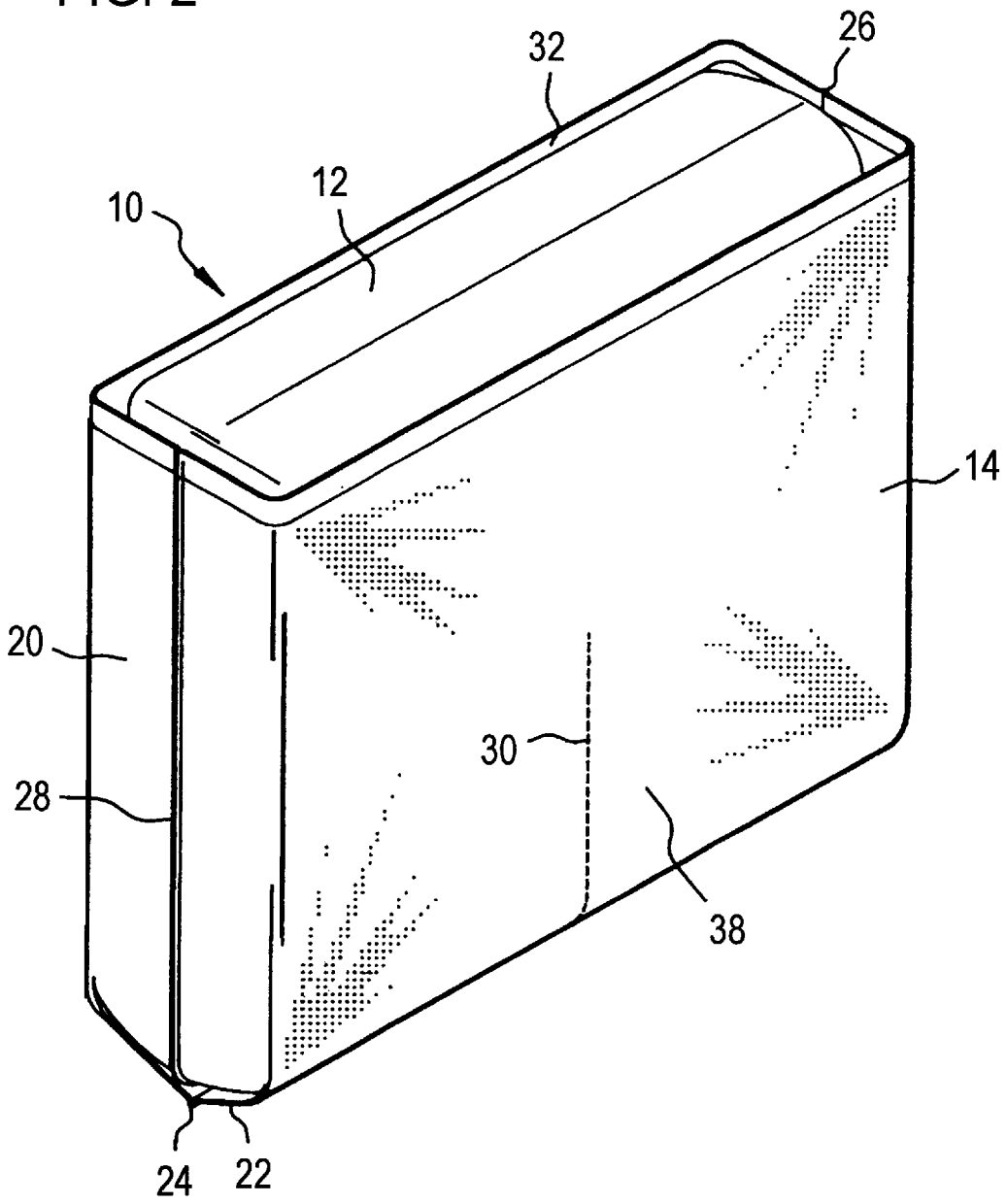
FIG. 2 shows a perspective view of the bag according to FIG. 1 in an upside-down position.
Figure 5:
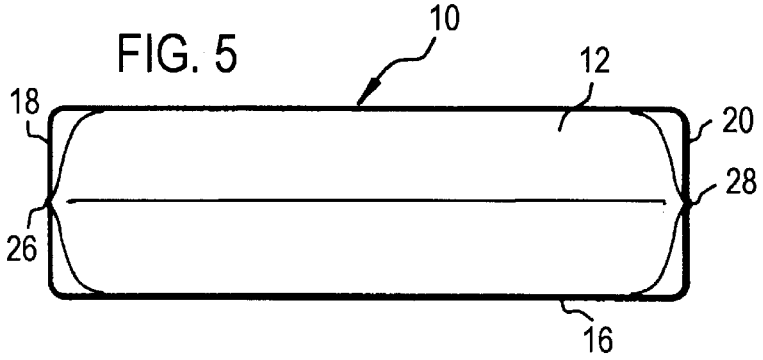
FIG. 5 shows a bottom view of the bag in FIG. 3.
Figure 3:
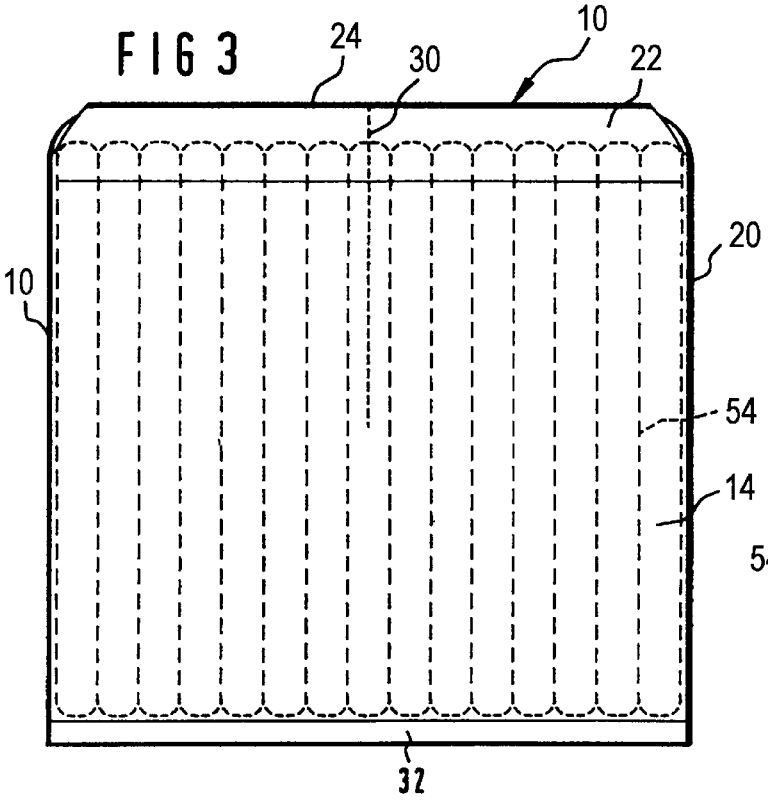
FIG. 3 shows a view of the front side of the bag.
Figure 6:
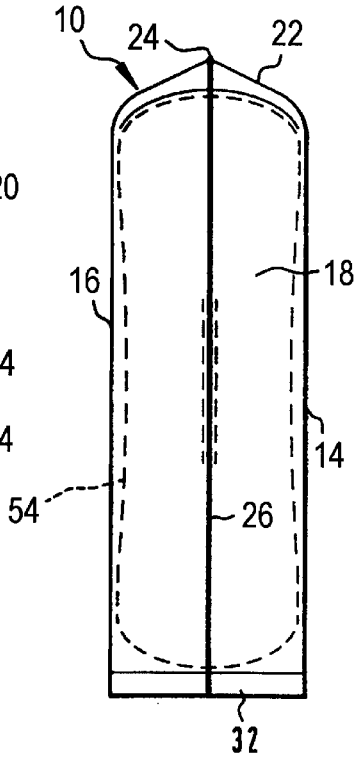
FIG. 6 shows a view of a narrow side of the bag in FIG. 3.
Figure 4:
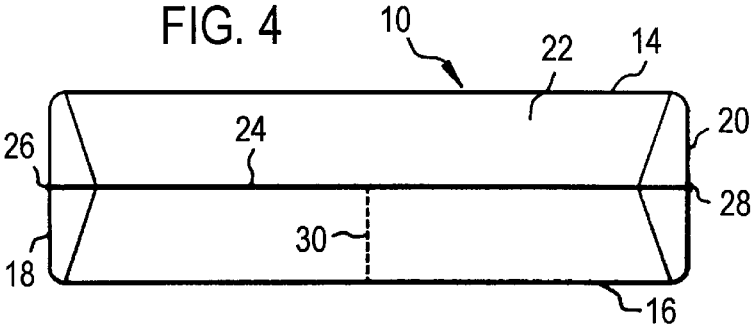
FIG. 4 shows a plan view of the upper side of the bag in FIG. 3.

Shown in FIGS. 1 to 6 is a flexible bag 10 for a plurality of compressible absorbent articles 54 which are arranged in parallel one beside the other. Preferably, these are articles for feminine hygiene, such as sanitary towels. The bag 10 has an approximately rectangular base 12, a front side 14, a rear side 16, two narrow sides 18, 20 and an upper side 22. Furthermore, the bag 10 is closed on all sides. The closure of the upper side 22 comprises, e.g., a weld seam 24 which extends over the longitudinal center of the upper side 22, between the two narrow sides 18, 20. The narrow sides 18, 20 of the bag 10 are closed, e.g., by weld seams 26, 28 which run vertically in the longitudinal center of the narrow sides 18, 20. The upper side 22 and front side 14 are provided with a line of weakness 30 which extends from the central weld seam 24 of the upper side 22 and, approximately perpendicularly with respect to said weld seam 24, approximately midway along the bag 10, downwards from the top approximately half way down the front side 14. Destroying this line of weakness 30 provides an opening for the individual removal of one of the articles. The line of weakness 30 may be formed in the manner of a notched line by perforating the film material 38 or, preferably, by reducing the thickness of the film material. In a preferred embodiment illustrated in FIG. 1, the line of weakness 30 is preferably approximately 110 mm.

The height of the bag 10 is defined essentially by the length of the articles to be packaged therein. The length of its front side 14 is a multiple of the depth of the bag or of the depth of a narrow side of the same. The base 12 is enclosed by a downwardly extending supporting band 32, as a standing aid. The material for producing the bag 10 is preferably a polyethylene film having a thickness of 0.040 mm. Depending on the application purpose, use may also be made, however, of a different film material of different dimensions.

The bag 10 comprises a single portion of such film, the base 12 being formed by a pushed-in section in the form of an inner fold 42 of film portions 44, 46 of the front side 14 and rear side 16. In order to produce the supporting band 32 which is guided around the base 12, on the underside thereof, full-surface sealing of the pushed-in film portions 44, 46 to the adjacent front side 14 and rear side 16, respectively, takes place, in the region of one of two outer folds 41, 43 formed by them, said sealing being of a width which corresponds to the height of the supporting band 32.

A process according to the invention provides for the following steps, for producing the bag 10, which are represented in the schematic drawing of FIGS. 7*a* to 7*j:*

Figure 7A:
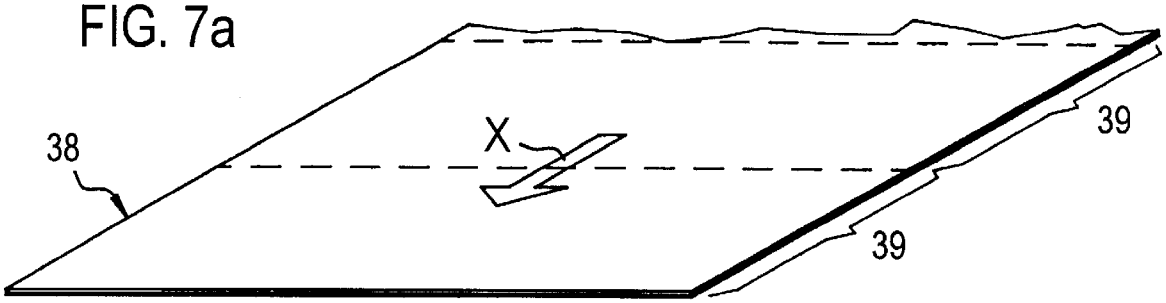
FIGS. 7*a* to 7*j* show process steps for producing the bag and for packaging absorbent articles in the same.
Figure 7B:
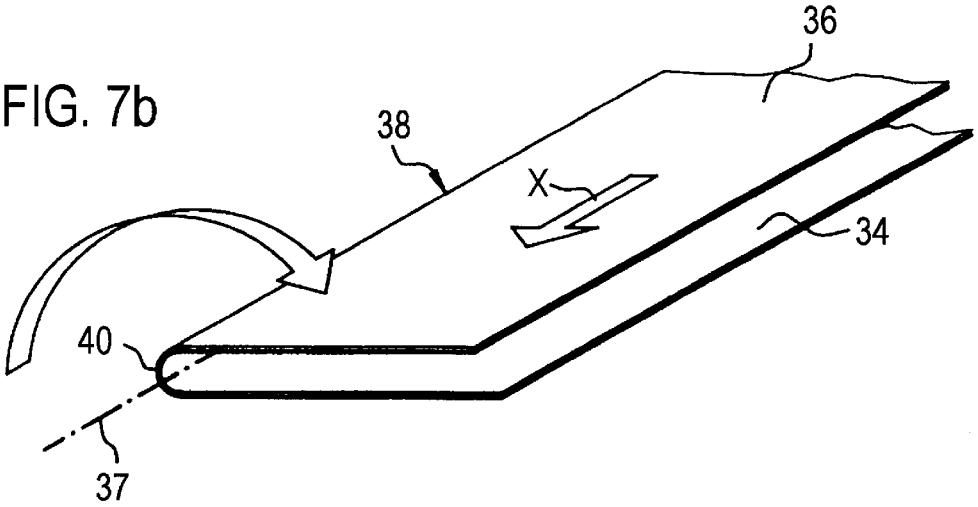

According to FIG. 7*a,* a continuous, planar web 38 comprising a plastic film is moved forwards, in arrow direction "x", in a stepwise manner in length portions 39 which correspond approximately to the length of the bag 10. According to FIG. 7*b,* the film web 38 is folded upon itself about a longitudinal axis 37, in doing so forming a longitudinal fold 40 on one longitudinal side and two longitudinal halves 34, 36, located one above the other, of the film web 38.

Figure 7C:
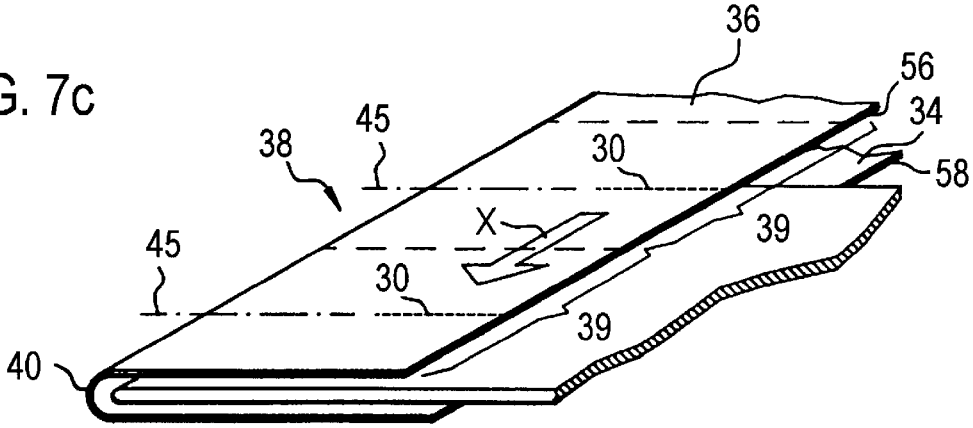

According to FIG. 7*c,* a line of weakness 30 is then produced in each case in a longitudinal center 45 of the length portions 39 of the upper longitudinal half 36 of the continuous film web 38, transversely with respect to the movement direction "x" of the film web 38, which line of weakness 30 extends from an outer border 56, which is parallel to the longitudinal fold 40 and belongs to the upper longitudinal half 36, in the direction of the opposite longitudinal fold 40, approximately as far as the center longitudinal axis of the upper longitudinal half 36 of the film web 38. The lower longitudinal half 34 projects laterally outward, by means of an outer border 58, beyond the outer border 56 of the upper longitudinal half 36.

Figure 7D:
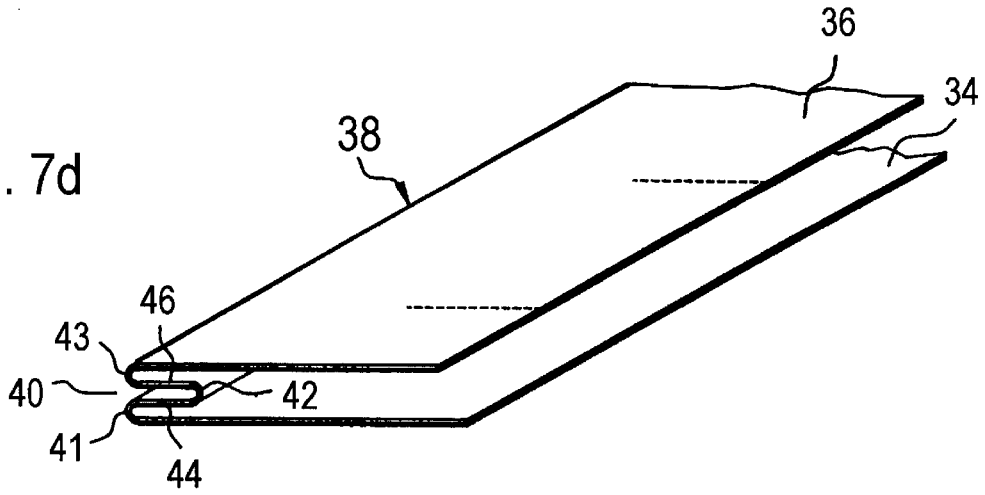

According to FIG. 7*d,* film portions 44, 46, located one above the other, of the lower and the upper longitudinal halves 34, 36 are pushed continuously inward at the longitudinal fold 40 in order to produce an inner fold 42. In this arrangement, the lower longitudinal half 34 of the film web 38 forms a lower outer fold 41 with the lower film portion 44 of the inner fold 42, and the upper longitudinal half 36 forms an upper outer fold 43 with the upper film portion 46.

Figure 7E:
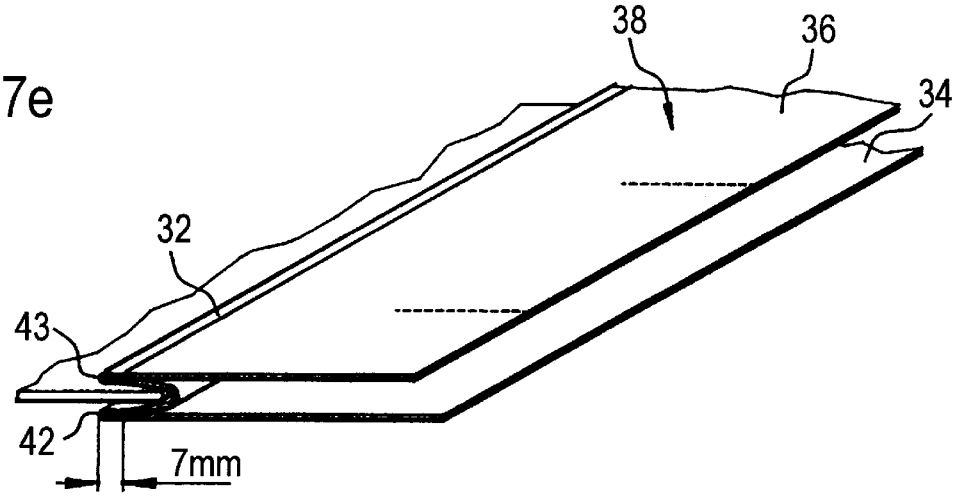

According to FIG. 7*e,* full-surface sealing in each case of the lower longitudinal half 34 of the film web 38 to the lower film portion 44 of the inner fold 40 takes place, in the region of the outer fold 41, and, separately therefrom, of the upper longitudinal half 36 of the film web 38 to the upper film portion 46 of the inner fold 42 takes place, in the region of the outer fold 43, a supporting band 32 being formed in the process, and said sealing being over a width which corresponds to the height of, for example, 7 mm of the supporting band 32.

Figure 7F:
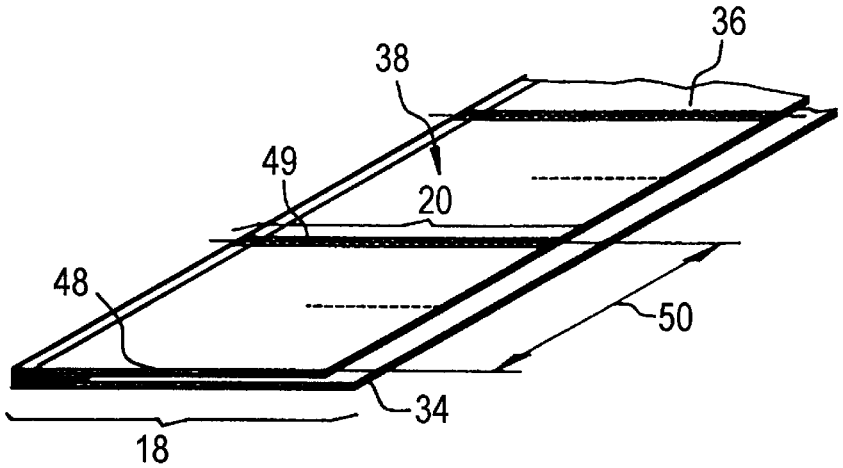
Figure 7G:
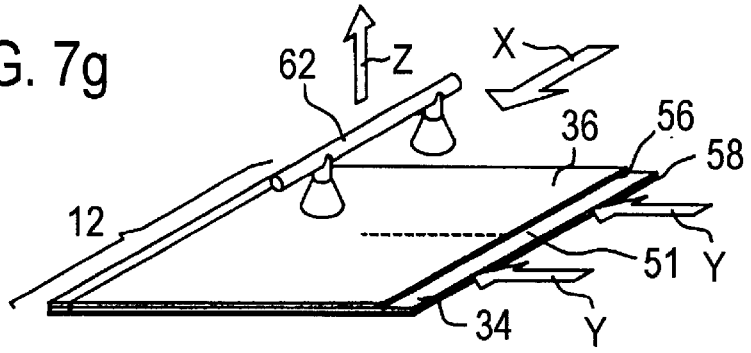

According to FIG. 7*f,* front and, subsequently, rear ends 48, 49 of length portions 50, corresponding to the length of a bag 10, of the longitudinal halves 34, 36, located one above the other, of the film web 38 are sealed one after the other in order to form the narrow sides 18, 20 of the bag 10 and are simultaneously severed from the film web 38. According to FIG. 7*g*, an introduction opening 51, formed by the outer borders 56, 58 of the two longitudinal halves 34, 36 and located opposite the base 12, of the bag 10 is opened and widened by a compressed-air jet "y" and two suction elements 62 in the direction "z".

Figure 7H:
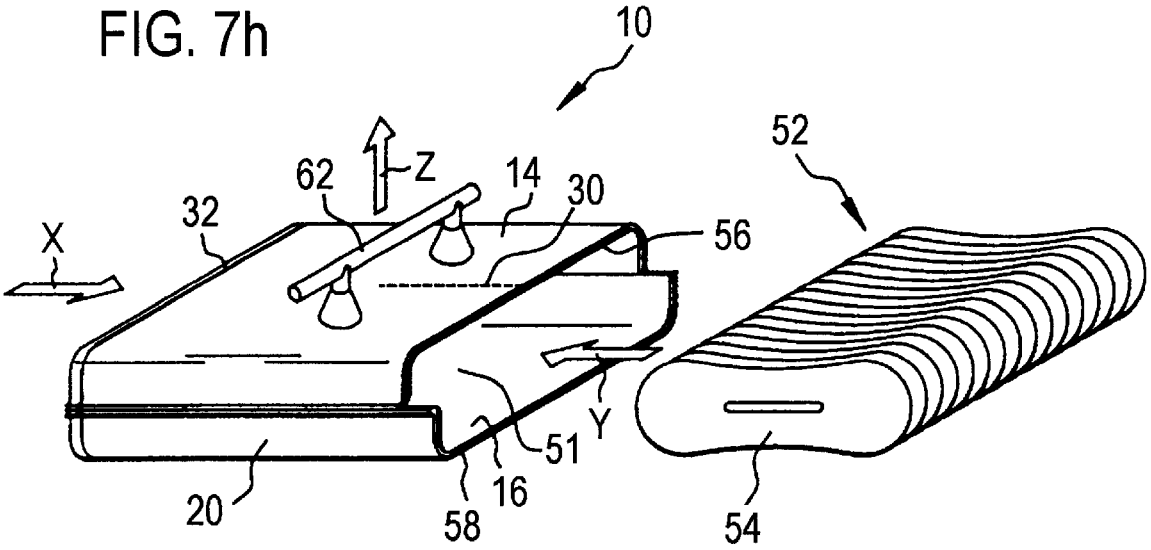
Figure 7I:
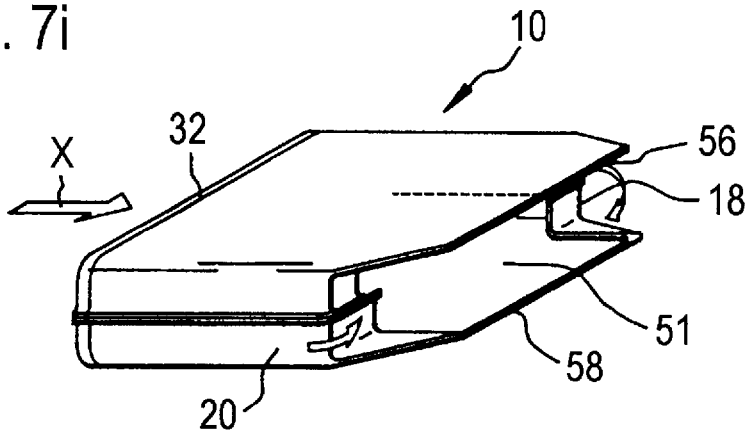

According to FIG. 7*h,* a stack 52 of longitudinally extending articles 54 is introduced into the bag 10, the articles being arranged with their main planes parallel to the narrow sides 18, 20. The number of articles 54, which in a preferred embodiment may be from 18 to 20 sanitary towels, be selected such that said articles do not exert sufficient force on the front side 14 and the rear side 16, located in parallel opposite said front side, or on the narrow sides 18, 20, spaced apart opposite one another in parallel, of the bag 10 to cause the opening to remain open in a relaxed condition. Furthermore, according to FIG. 7*i,* the outer borders 56, 58, enclosing the introduction opening 51, of the film material 38 are folded inward on the narrow sides 18, 20 in order to close the introduction opening 51 partially.

Figure 7J:
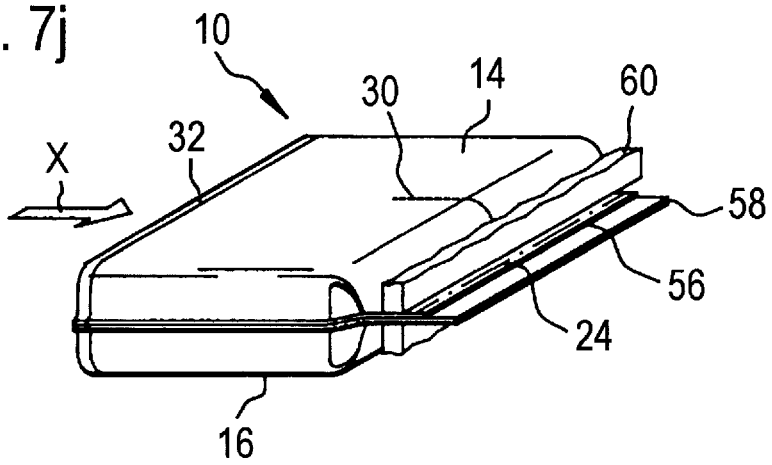

According to FIG. 7*j,* the introduction opening is then closed by pressing the outer borders 56, 58, assigned to the front side 14 and the rear side 16 of the bag 10, against one another and sealing them, e.g., by means of a welding-roller pair 60, and any film jutting out beyond the weld seam 24 is severed by the welding rollers.

Upon opening the closed bag 10 filled with the absorbent articles 54, a compressive force is exerted on the upper region of the rear side 16 of the bag 10, while, at the same time, bending forces or tensile forces are exerted on the bag 10 on both sides of the line of weakness 30, with the result that the line of weakness 30 is destroyed and a removal opening is provided in its place, through which removal opening in each case one absorbent article 54, such as a sanitary towel, can be removed. Said removal is readily possible because the sanitary towel has been introduced into the bag, in a stack comprising a plurality of elements, without any great amount of pre-stressing, such as compression. Consequently, the compressible articles packaged in the bag do not exert any great amount of expansive force, by means of which the removal opening produced by destroying the line of weakness 30 would maintain a wide-open position, on the narrow sides 18, 20 of the bag 10 from the inside. Rather, the removal opening closes again to a great extent after an article has been removed from the bag 10. This closing of the removal opening is, furthermore, assisted by the supporting band 32 if the bag 10 is deposited on a planar surface after it has been used.

List of designations

| | |
|---|---|
| 10 | Bag |
| 12 | Base |
| 14 | Front side |
| 16 | Rear side |
| 18, 20 | Narrow sides |
| 22 | Upper side |
| 24 | Weld seam (upperside 22) |
| 26 | Weld seam (left-hand narrow side) |
| 28 | Weld seam (right-hand narrow side) |
| 30 | Line of weakness |
| 32 | Supporting band |
| 34, 36 | Longitudinal halves (film web 38) |
| 37 | Longitudinal axis |
| 38 | Film web |
| 39 | Length portions |
| 40 | Longitudinal fold (film web) |
| 41, 43 | Outer folds |
| 42 | Inner folds |
| 45 | Longitudinal center |
| 44, 46 | Film portions |
| 48, 49 | End (front and rear of 39) |
| 50 | Severed length portions |
| 51 | Introduction opening |
| 52 | Stack |
| 54 | Articles (sanitary towels) |
| 56, 58 | Outer borders |
| 60 | Weldinq-roller pair |
| 62 | Suction elements |
| x | Movement direction |
| y | Compressed-air jet |
| z | Suction element direction |

What is claimed is:

1. A process for producing a flexible bag and for packaging compressible, absorbent articles therein, comprising the steps of:

conveying a continuous, planar web comprising a plastic film forwards in a stepwise manner in length portions which correspond approximately to the length of the bag;

folding the film web upon itself in a substantially horizontal plane about a longitudinal axis, in doing so forming a longitudinal fold on one longitudinal side and two longitudinal halves, located one above the other, of the film web;

pushing film portions, located adjacent to one another, of two longitudinal halves continuously inward at the longitudinal fold in order to form an inner fold, the longitudinal halves of the film web forming two outer folds with the film portions of the inner fold;

producing a line of weakness proximate a longitudinal center of the upper longitudinal half of said length portions, substantially transversely to the direction of movement of the film web, which line of weakness extends from an outer border, which is parallel to the longitudinal fold and corresponds to the upper longitudinal half, toward the longitudinal fold, approximately half way to the outer fold;

sealing one longitudinal half of the film web to one film portion of the inner fold in the region of the outer fold, and separately therefrom, but simultaneously, sealing the upper longitudinal half of the film web to the upper film portion of the inner fold in the region of the outer fold, said sealing being over a width which corresponds to the height of a supporting band;

sealing front and, subsequently, rear ends of the length portions, corresponding to the length of a bag, of the longitudinal halves, located adjacent to one another, of the film web in order to form the narrow sides of the bag and substantially simultaneously severing the bag from the film web;

directing a compressed-air jet towards outer borders of the two longitudinal halves, located opposite the base to open an introduction opening of the bag;

introducing a stack of articles into the bag through the introduction opening;

folding inward the outer borders enclosing the introduction opening of the film material in order to close the introduction opening partially;

pressing together the outer borders corresponding to the front side and the rear side of the bag, against one another; and sealing the pressed together outer borders.

2. The process of claim 1 wherein a sufficient number of articles are combined to form a stack and introduced into the bag such that the articles do not exert sufficient expansive force on any of the sides to force the bag to gape open after destruction of the line of weakness.

3. The process of claim 1 wherein the web comprises polyethylene.

4. The process of claim 1 which wherein the opening of the bag is aided by suction means.

* * * * *